US007343949B1

(12) United States Patent
Vandevoorde

(10) Patent No.: US 7,343,949 B1
(45) Date of Patent: Mar. 18, 2008

(54) INSTALLATION FOR TREATING PARTS SUCH AS LABELS OR SLEEVES FOR LABELING AND PRESENTATION OF BOTTLES

(76) Inventor: Jean-Claude Vandevoorde, 39, route d'Ailly, F-80500, Montdidier (FR)

( * ) Notice: Subject to any disclaimer, the term of this patent is extended or adjusted under 35 U.S.C. 154(b) by 503 days.

(21) Appl. No.: 09/959,065

(22) PCT Filed: Apr. 19, 2000

(86) PCT No.: PCT/FR00/01030

§ 371 (c)(1),
(2), (4) Date: Oct. 16, 2001

(87) PCT Pub. No.: WO00/36101

PCT Pub. Date: Oct. 26, 2000

(30) Foreign Application Priority Data

Apr. 19, 1999 (FR) ..... 99 04873

(51) Int. Cl.
*B32B 41/00* (2006.01)

(52) U.S. Cl. ..... 156/351; 156/360; 156/361; 156/378; 156/379

(58) Field of Classification Search ..... 156/353, 156/351, 360, 361, 378, 379; 83/76.6, 76.7, 83/76.8, 76.9, 364, 365, 367, 368, 369
See application file for complete search history.

(56) References Cited

U.S. PATENT DOCUMENTS 4,519,868 A * 5/1985 Hoffmann ..... 156/353
4,949,607 A * 8/1990 Yuito ..... 83/76.7
5,095,219 A 3/1992 Laumann et al.
5,383,130 A 1/1995 Kalisiak
5,447,486 A 9/1995 Anderson et al.
5,765,460 A * 6/1998 Wathieu ..... 83/37
5,795,280 A 8/1998 Fowler et al.
5,862,968 A 1/1999 Traise
6,196,098 B1 * 3/2001 Hagiwara et al. ..... 83/79

FOREIGN PATENT DOCUMENTS

EP 0 761 546 A1 3/1997
EP 0 771 623 A2 5/1997

OTHER PUBLICATIONS

International Preliminary Examination Report, PCT/FR00/01030, Int'l Filing Date Apr. 19, 2000, Priority Date Apr. 19, 1999.

* cited by examiner

*Primary Examiner*—George Koch

(57) ABSTRACT

The invention concerns an installation comprising a feeding device (100, 101, 103, 104, 1, 11, 12) unwinding the support (G) and a treating device (105, 4) for operating on the parts (P). A reading unit (102) positioned on the passage (Z) of the bar codes (CB) of the parts (P), supplies signals (SL). A data source (107) contains data concerning the bar codes (CB). A control circuit (106, 5) receives the sense signals (SL) and the data signals (SD) so as to compare them and transmit control signals (SC) for the treating device (105, 4).

7 Claims, 2 Drawing Sheets

INSTALLATION FOR TREATING PARTS SUCH AS LABELS OR SLEEVES FOR LABELING AND PRESENTATION OF BOTTLES

BACKGROUND OF THE INVENTION

1. Field of the Invention

The present invention relates to a mechanism for processing items continuously fed on a base strip or tubing material, such as labels or sleeves to be applied to containers, in order to perform an operation on each item, in which each item provided with a bar code must be accurately positioned, this mechanism having a feed device to unreel the base material and a controlled processing device to perform the operation on the items.

The invention relates in particular, although not exclusively, to a mechanism for cutting items fed continuously and printed continuously on a strip or tubing, such as labels or sleeves to be placed on containers, in particular bottles, each of the printed surfaces having a printed indicium of the bar code type to enable the items to be severed one by one from the unreeled strip.

2. Description of the Related Art

A method of providing bottles or containers of this type with stretch or shrink labels is already known, i.e. which are elastically pulled over the item on which they elastically shrink or which are placed on the item without being deformed and then put through a heat shrinking process.

These sleeves are unreeled from tubing, i.e. from a continuous, flat reeled tube on which the various indicia or the sleeve label and a bar code are imprinted.

At the instant at which these sleeves are placed on the bottles, the tubing is unreeled and the machine tears off the sleeves one by one to engage them on the bottles.

However, this known solution has a certain number of disadvantages, the most important one being that a tear off line has to be made, separating two sleeves or two pieces of the tubing. This requires an operation in addition to that of printing the tube. This operation is delicate since it requires accurate alignment with the sleeve printing system.

Document U.S. Pat. No. 5,383,130 discloses an in-line printing system for folded sheets. This system uses marks of a predetermined design. The system detects this mark in order to make the fold. A device of this type requires an expensive process of applying specific marks on the sheets to be folded.

Another method, known from document U.S. Pat. No. 5,095,219, involves cutting a strip of material to ensure that products are cut to the correct length. Each bar of the bar codes is transferred into a signal which is in turn converted in order to obtain cutting accuracy. It is the length measurement in each bar code which is used to operate the machine. A method of this type is complex and requires expensive operating means.

Similar processes are known for items such as labels, unreeled from a continuous strip.

SUMMARY OF THE INVENTION

The objective of the present invention is to develop a plant that will enable operations to be performed on items, where each item must be accurately positioned relative to the processing device or in particular for severing the items such as labels or printed sleeves continuously from a base material such as a tube or strip so that the items can be severed easily and accurately in readiness for application to the item on which they are to be affixed.

To this end, the present invention relates to a mechanism including a reader positioned on the passage at which the bar codes of the items are located, supplying a set of read signals; a data source containing information relating to the bar codes; and a control circuit receiving the read signals and the data signals, comparing the reading and data signals, emitting control signals for the processing device based on the comparison of the signals.

The mechanism enables operations to be performed on an item that is accurately identified using an existing element without having to apply specific marks, i.e. the bar code already printed on the item and occupying a specific and known position relative to the item.

This bar code is accurately positioned relative to each item and therefore enables an operation to be performed such as cutting an item, in particular the sleeve, at a specific point in the base material since it no longer needs to be perforated along the line joining two items.

It is particularly important to be able to detect any potential variance between the theoretical length and the actual length of the item, particularly the label or sleeve, if the base material is a plastic such as generally used for tubes, since this material is sometimes susceptible to random slippage relative to the unreeling cylinders; depending on how great the error is between the theoretical length and the actual length of the item, there is a risk that the latter will be inaccurately cut and these errors will not necessarily be compensated from one item to another but run the risk of being compounded and, as they are compounded, will very rapidly lead to a very large margin of error in severing the items, rendering them unusable.

The mechanism proposed by the invention, which corrects each error in length for each item, avoids a build-up of errors. Since the length error on one item is negligible or at least not actually perceptible, the fact that the correction is applied with a shift of one item is of no practical significance.

Similarly, the operation, such as cutting, is shifted relative to the process of detecting the printed information or indicia to be read. This shift corresponds to a whole number of item lengths. It will generally be several items and there can be no significant variation in the length between the measurement point and the cutting point and hence the position of the cutting line.

The solution proposed by the invention, based on reading the bar code, is of particular interest since bar code readers are easily able to detect this code and, in particular, serve as a means of detecting the exact position of the bar code.

In a particularly interesting manner, the means for measuring the unreeled length is the incremental sensor cooperating with an indexed wheel integral with one of the unreeling rolls of the unreeling device.

As a result of another advantageous feature, the machine has a cutting device downstream of the bar code reader, offset from it by a whole number of item lengths and controlled in a staggered manner by the control device.

A mechanism of the type proposed by the invention may advantageously be applied for in-line processing or production lines receiving items as a continuous strip on which operations have to be performed, in particular accurate severance of the items as is the case with a machine used to place sleeves on bottles; this mechanism is combined with the sleeve fitting turret, for example, so as to operate in synchronisation.

BRIEF DESCRIPTION OF THE DRAWINGS

The present invention will be described in more detail below by reference to a mechanism for cutting items such as labels or sleeves, in conjunction with the appended drawings, of which.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
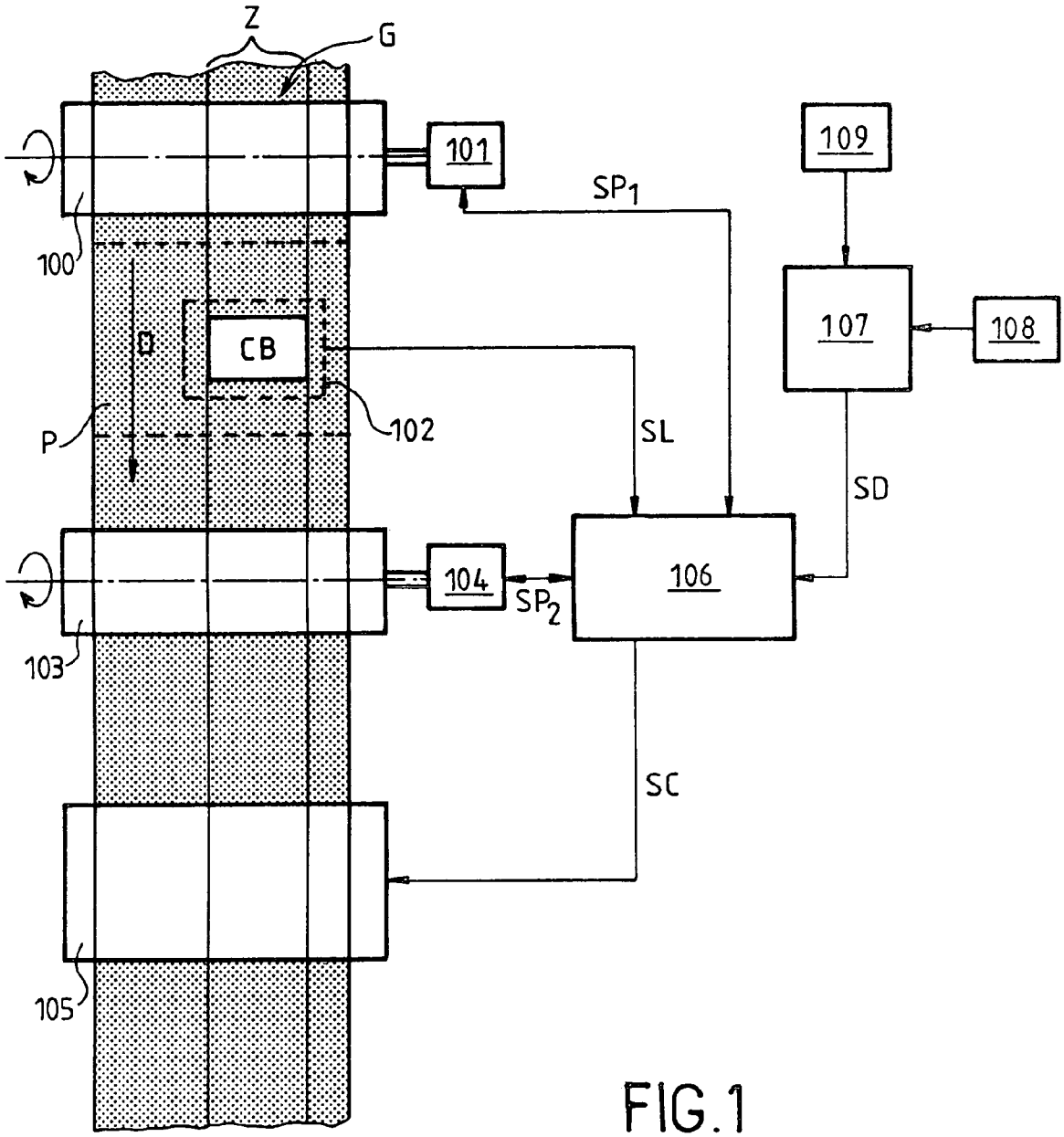
FIG. 1 is a schematic illustration of a mechanism as proposed by the invention.

As illustrated in FIG. 1, the invention generally relates to a mechanism for processing items P fed continuously on a base material G. These items, each of which is provided with a bar code, are, for example, labels or sleeves to be placed on containers and the mechanism must perform a certain operation on each item. This operation requires each item to be accurately positioned.

The mechanism incorporates an unreeling device 100, provided in the form of one or two cylinders, for example, one or both of them being driven by a motor 101 causing the base material G to be fed in the direction of arrow D. A single item P with its bar code CB is shown on the tubing G for the purposes of this description. In fact, the items are disposed on the base material G one after the other in an almost continuous fashion.

Downstream of the unreeling device 100, the mechanism has a reader 102 straddling the zone Z of the base material G in which the bar code CB is located. This zone Z is defined and known.

Downstream of the reader 102, the mechanism has a downstream unreeling or drive device 103 also consisting of one or two cylinders, at least one of which is driven by a motor 104. Finally, downstream of the device 103, the mechanism has a processing device 105 which performs the operation. This device 105 may be a printing or cutting tool, for example, which is required to perform an operation at a specific point on the item. This specific point is defined from the outset relative to the location of the bar code CB.

The mechanism also has a control circuit 106, which receives the read signal SL from the reader 102 and position or drive signals, SP1 emitted as schematically indicated by the motor 101 and SP2 supplied as schematically indicated by the motor 104. These signals SP1, SP2 may be signals from readers co-operating with a optical disk mounted on the output shaft of the motors 101, 104 as a means of accurately identifying the angular position of the shaft of the motors and thus directly or indirectly issuing a signal corresponding to the position of the base material G or the length unreeled.

The control circuit 106 is also linked to a date source 107, which contains the information relating to the bar codes. This information is the data relating to position, dimensions and more generally characteristics of the bar codes. Depending on the data to be encoded, the bar codes will vary in dimensions (length and width) and number of segments. All of this information is used to ascertain the theoretical position of the bar code on the base material G inside the zone Z, for example.

The information from the data source 107 is supplied by an external source 108 such as a CD ROM reader or a learning model reader 109 which is also a learning system or library of codes (code file), into which a sample of bar code CB from the base material G to be processed is read. This model reader 109 then determines the characteristics of the bar code to be read so that this bar code contained in the reading signals supplied to the control circuit 106 can be recognized on the basis of a comparison between the read signals SL and the comparison signals SD supplied to the control circuit 106 by the data source 107.

On the basis of the different signals received, the control circuit 106 generally emits a control signal SC addressed to the processing device 105 so that it can perform the operation.

In one embodiment, the reader 102 may be a bar code reader which contains the data source 107. The reader 102 may also be a camera which is trained by means of the model reader 109, signals applied to the data source 107 by this reader being processed, then compared, followed by processing of the signals in the circuit 106.

Figure 2:
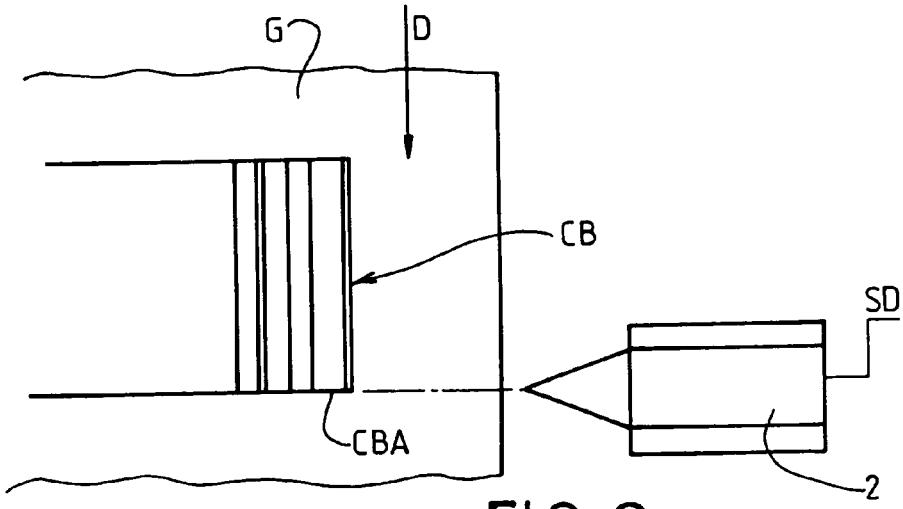
FIG. 2 is a detail taken from FIG. 1.

FIG. 2 is a schematic illustration showing detection of the edge CBA in the feed direction D of the bar code CB, seen on an enlarged scale. The detection system illustrated operates on the basis of the leading edge (in the direction feed) although this solution is merely an example since it would also be possible to detect the trailing edge.

Figure 3:
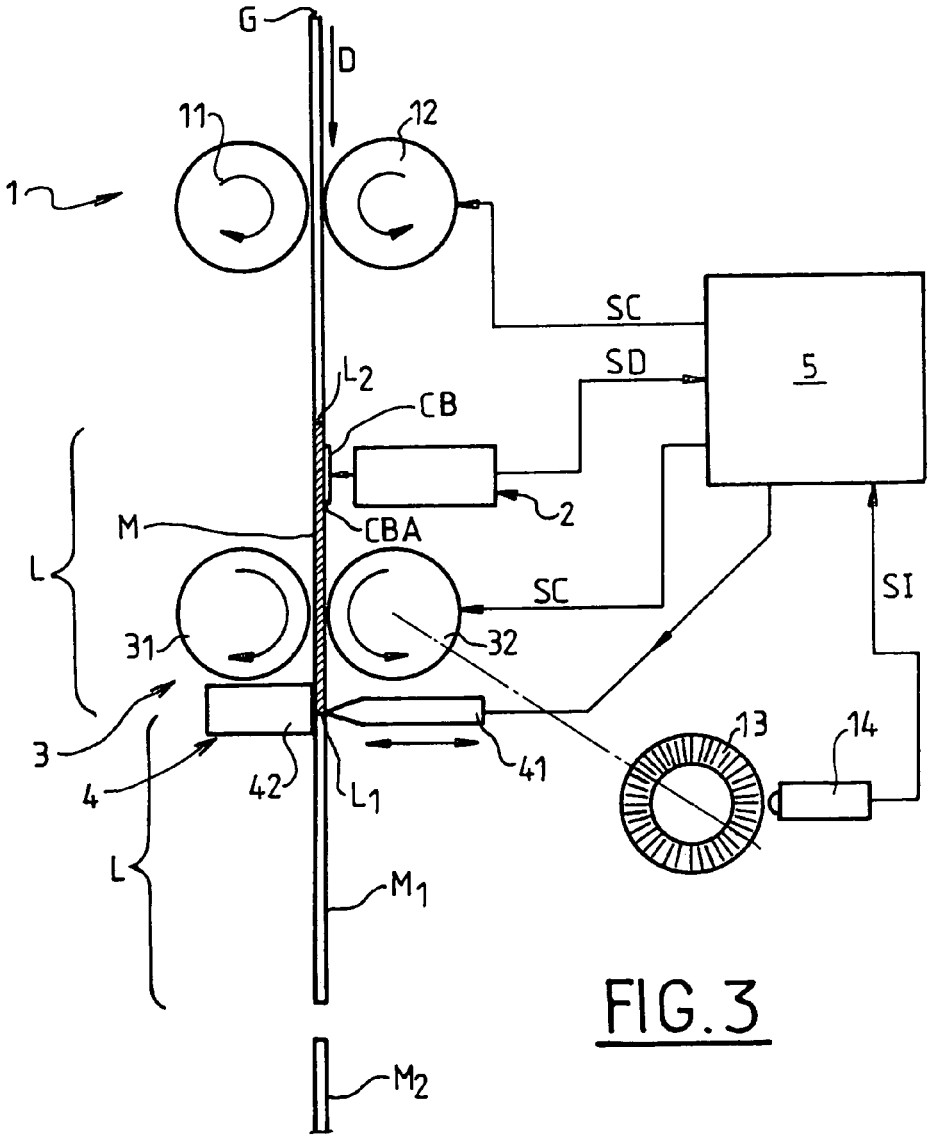
FIG. 3 is a diagram of a sleeve unreeling system.

Turning to FIG. 3, the invention will be described by reference to an example in which the embodiment is a mechanism for cutting continuously printed items on a continuously fed base material. The operation to be performed on the items as they arrive continuously is cutting; the items are sleeves to be placed on bottles which arrive in the form of a continuous tubing G having printed surfaces corresponding to each sleeve. These printed surfaces incorporate a bar code CB.

The mechanism has a forward-feed unreeling device 1 comprising two cylinders 11, 12 between which the tubing G to be unreeled is fed. At least one of the cylinders 11, 2 is driven by a motor and the other is elastically applied against the first in order to clamp the tubing G and drive it in the direction of arrow D.

Downstream of the forward-feed unreeling device 1, the mechanism has a reading device 2 for reading the bar code CB printed on the tube G. Finally, downstream of the reading device 2, a downstream unreeling device 3 consisting of two cylinders 31, 32 pulls the tube G whilst a cutting device 4 with a blade 41 and a counter blade 42 operates the cutting. The various devices 1, 2, 3, 4 are linked to a control circuit 5 which receives the detection signals corresponding to the length measurement of the unreeled tubing and, on detecting the marker in the form of the printed imprint CB, it controls the driving action of the tubing via the upstream unreeling device 1 and via the downstream unreeling device 3, in particular to regulate the tension between the two unreeling devices, as well as the cutting device 4. The devices 1, 3 receive control signals SC from the circuit 5.

The tubing G forming the base material for individual items (in this case sleeves) allows a sleeve length L to appear between the bottom edge L1 and the top edge L2 delimiting a sleeve. Between the two boundaries L1, L2, the tubing has a bar code CB which is specifically positioned relative to the bottom edge and the top edge L1, L2 of the sleeve M.

Downstream of the sleeve M passing through the detection system is a sleeve M1 which is on the point of being severed by the cutting device 4 from the top edge L1 of the sleeve M still forming part of the tubing G and finally a sleeve M2 which has already been severed.

More specifically, the tubing G is driven by the two rolls 31, 32 of the unreeling device 3. One of the rolls, for example roll 32, is joined in rotation with an indexed wheel 13. This wheel 13 is detected by a sensor 14 supplying an incremental signal SI to the control circuit 5.

In theory, the tubing G does not slide relative to the rolls 31, 32. In practice, there may be a certain amount of slippage, albeit minimal, which it is vital to correct in order to avoid a build-up of errors which could cause a sleeve to be cut at an inappropriate point. To this end, the measuring device provided in the form of the indexed wheel 13 and the sensor 14 supplies the incremental signals SI starting from an initial instant fixed by the control circuit 5, corresponding to the end of the unreeling measurement of the preceding sleeve; this measurement will be corrected under the conditions explained below. The incremental signals SI are counted by incrementing a counter starting from an initial value, generally zero, up to a final value corresponding to the end of the unreeling of a sleeve. The initial instant of the start of counting theoretically corresponds to the start of a sleeve and counting continues until unreeling has reached a point at which the sleeve to be cut is of a length L. The end of unreeling corresponds to the instant at which the bar code reader 2 detects the leading edge CBA of the bar code CB. However, this measurement of the unreeled length may be equal to, less than or greater than the actual length of the sleeve. In order to control the end of the unreeling, the mechanism has a bar code CB reader. IN this instance, this reader 2 detects the leading edge CBA of the bar code and sends a detection signal SD to the control device 5; it knows at this moment that the correct length of tubing has been unreeled, allowing the sleeve to be cut. The leading edge CBA of the bar code CB is the bottom edge as illustrated in FIG. 3. The reader 2 reads the bar code CB at a feed speed of the tubing G which is relatively slow, controlled by the circuit 5 once the measuring device 13, 14 has emitted the signals SI which, together, substantially correspond to the sleeve length to be unreeled.

In effect, for each sleeve M, the measuring system 13, 14 starts at a point zero. To unreel a new sleeve, the system makes allowance for the error in the length of tubing unreeled for the preceding sleeve under conditions that will be described later. Starting from this position of the tubing (which corresponds to the position of the start of a sleeve at the point at which it is cut for example), the unreeling devices 1, 11, 12, 31, 32 unreel a length of sleeve corresponding to the true length of the sleeve. However, this length is unreeled on the basis of the unreeling measurement (SI), i.e. the rotation of the rolls 31, 32 measured by the sensor 13, 14. This rotation of the roll or rolls 31, 32 does not necessarily correspond to the length of tubing actually unreeled because there may have been some slippage between the tubing G and the rolls 31, 32. In the conditions under which the machine is operated, this slippage will nevertheless be slight. However, even though this slippage is slight, if it were not corrected after unreeling each sleeve, it would then lead, due to an accumulation of errors, to significant differences and sleeves would gradually start to be cut with their images and text spilling one into the other which would finally lead to sleeves being cut with, for example, two unconnected design parts, one from the preceding sleeve and the other from the following sleeve.

When the theoretical tubing length has been unreeled (length corresponding to a sleeve or immediately before the end of this unreeling) the unreeling by the rolls 11, 12, 31, 32 slows down and the reader 2 detects the arrival of the leading edge CBA (bottom edge) of the bar code CB. This leading edge CBA can then be read under sufficiently accurate conditions relative to the system (to avoid any error which might be introduced in the period between two scans by the reader 2 as the tubing G is fed along).

When the reader encounters the bottom edge CBA (or upstream edge) of the bar code CB, it transmits the corresponding signal SD to the control device 5, which then detects that the correct length of the label or sleeve has been unreeled.

The comparison between the measurement signal supplied by the sensor 14 co-operating with the roll 12 at the instant at which the edge CBA of the bar code CB is read and the reference measurement, supplied to the rolls 11, 12 to initiate unreeling at the start of this operation, give a correction signal SC which is used for the next sleeve unreeling operation.

As a result of the correction applied at the instant of unreeling and making allowance for the unreeling error of the preceding sleeve (sleeve M1), the sleeve M downstream or on a level with the reader 2 is therefore correctly positioned relative to the operating accuracy of the mechanism or the accuracy needed to ensure correct cutting of the sleeve.

The control circuit 5 may then issue a command to the cutting device, illustrated schematically by the moving blade 41 and the counter-blade 42, to sever a sleeve M1 downstream. In the example illustrated in FIG. 2, the measurement is taken on the sleeve M as the preceding sleeve M1 is being cut at the end of the unreeling. It may also be that there is a larger number of sleeves downstream of the bar code reader 2 waiting to be cut by the cutting device 4, depending on the mechanism data and the space available between the bar code reader 2 and the cutting device 4. It should be pointed out that the rolls 31, 32 of the unreeling device 3 downstream of the reader 2 are also used to hold the tubing G within the passage of the bar code reader 2.

Downstream of the sleeve M1, is a sleeve M2 already cut.

The invention is not restricted to cutting operations but applies to all operations to be performed on a non-severed item belonging to a continuous unit in the form of a strip or tubing and requiring accurate location of the position of each item in order for the operation to be performed on it without having to apply a specific mark to the items beforehand but instead using an element already existing on the item, accurately positioned relative to the item but whose purpose is not that of a marker.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

The invention claimed is:

1. A mechanism for processing items continuously fed on a base material, in order to perform an operation on each item, in which each item is provided with an accurately positioned bar code, said mechanism comprising:

a feed device unreeling the base material;

a processing device for performing the operation on the items;

a reader positioned at a location in which the bar codes of the items are located, said reader being configured for detecting a particular edge of the bar code carried by each item, said reader further being configured for creating a read signal corresponding to a relative position of the detected bar code;

a data source containing data signal information relating to the bar codes; and a control circuit configured for receiving the read signals and the data signals and then comparing the read signals and the data signals, said control circuit emitting control signals for said processing device based on said comparison of the signals.

2. The mechanism as claimed in claim 1 in which said data source receives the information relating to the bar code to be read from a learning system.

3. The mechanism as claimed in claim 1 in which said control circuit receives data signals from said feed device of the base material.

4. The mechanism as claimed in claim 1 further comprising:

a means for measuring the length of the unreeled item starting from a given instant; said reader of the bar code carried by each item detecting the true position of the bar code when the item is practically in a halted position in readiness for the operation to be performed and said control circuit creating a correction length to be calculated corresponding to the difference between the theoretical position of the bar code at the end of unreeling the item and its real position obtained by said measuring means; said control circuit utilizing the signal corresponding to this difference to order to correct the forward feed of the next item as it is unreeled from the base material and to control said processing device.

5. The mechanism as claimed in claim 4 in which said means for measuring the unreeled length is an incremental sensor co-operating with an indexed wheel joined to said feeding device of the unreeling rolls of the unreeling device.

6. The mechanism as claimed in claim 1 in which the mechanism feeds one of labels or sleeves and the base material is one of a strip or tubing.

7. The mechanism as claimed in claim 1 wherein said processing device is a cutting device located downstream of said reader offset from the latter by a whole number of item lengths and controlled in a staggered fashion by said control circuit.

* * * * *